US006293786B1

(12) United States Patent
Lasagni et al.

(10) Patent No.: US 6,293,786 B1
(45) Date of Patent: Sep. 25, 2001

(54) BURNER WITH VENTURI TUBE AND FLOW DISTRIBUTING ELEMENTS

(75) Inventors: Feliciano Lasagni, Vignola; Giuseppe Fogliani, Formigine, both of (IT)

(73) Assignee: Worgas Bruciatori S.r.l., Formigine (IT)

( * ) Notice: Subject to any disclaimer, the term of this patent is extended or adjusted under 35 U.S.C. 154(b) by 0 days.

(21) Appl. No.: 09/445,267

(22) PCT Filed: Jun. 4, 1998

(86) PCT No.: PCT/EP98/03329

§ 371 Date: Mar. 29, 2000

§ 102(e) Date: Mar. 29, 2000

(87) PCT Pub. No.: WO98/55801

PCT Pub. Date: Dec. 10, 1998

(30) Foreign Application Priority Data

Jun. 5, 1997 (IT) ..... MO97A0103

(51) Int. Cl.[7] ..... F23D 14/58; F23D 14/10; F23D 14/62

(52) U.S. Cl. ..... 431/354; 239/432; 239/553.3

(58) Field of Search ..... 239/432, 556, 239/553, 553.3; 431/328, 354

(56) References Cited

U.S. PATENT DOCUMENTS 1,507,791 * 9/1924 Packer ..... 431/354
2,533,104 * 12/1950 Golden et al. ..... 431/328
3,185,204 * 5/1965 Loeb et al. .
3,353,583 * 11/1967 Silhavy .
4,413,976 * 11/1983 Sherer .
4,927,355 * 5/1990 Haire et al. ..... 431/329

FOREIGN PATENT DOCUMENTS

2350846-A * 4/1974 (DE) .
0217470-A * 4/1987 (EP) .
686808 * 12/1995 (EP) .
1577719-A * 8/1969 (FR) .
1499211-A * 1/1978 (GB) .
1517957-A * 7/1978 (GB) .
2266585-A * 11/1993 (GB) .

* cited by examiner

*Primary Examiner*—Carl D. Price
(74) *Attorney, Agent, or Firm*—Reising, Ethington, Barnes, Kisselle, Learman & McCulloch, P.C

(57) ABSTRACT

A burner fed with a flow of an air-fuel mixture, has a venturi tube arranged at the inside of a tubular burner body provided with through apertures through which said flow passes. The venturi tube is supported and centered in the body at one of its ends. Additional support and centering means of said venturi tube are provided at the inside of said tubular body. The additional support and centering means are provided with control means controlling the distribution of said flow of said air-fuel mixture.

26 Claims, 3 Drawing Sheets

BURNER WITH VENTURI TUBE AND FLOW DISTRIBUTING ELEMENTS

The invention concerns a burner with Venturi tube, provided with flow distributing elements.

In the burner equipped with Venturi tube, the fuel is fed at a certain pressure and speed to the mouth of the Venturi tube, causing the aspiration of a certain quantity of air, the so-called primary air, which is mixed to the fuel at the inside of the Venturi tube and, after leaving the tube, is distributed to the slots of the burner diffuser.

The distribution of the mixture air-fuel to the slots of the burner diffuser is usually not uniform, thus generating a non-uniform flame and causing both the flame to be detached from some areas of the diffuser, even in normal operating conditions, and the flame to be flattened on the surface of some areas of the diffuser, which causes overheating of said surface.

In addition, the Venturi tube is fixed to the diffuser at one end, for example by means of welding, whilst the other end remains free. Therefore, the Venturi tube acts as a beam fixed at one end, bending owing to its own weight and being subject to a danger of permanent strains, caused, for example, by impacts or by temperature variations to which the burner is subject during operation. The bending of the Venturi tube aggravates the non uniformity of the distribution of the mixture to the slots of the diffuser.

It is known from DE-2350846 a burner fed with a flow of an air-fuel mixture, comprising a Venturi tube arranged at the inside of a burner body provided with apertures through which said flow passes, said Venturi tube being supported to said body at one of its ends and being further supported two rows of baffles distributed through the whole length of the burner. The baffles are capable of generating vortices in the flow of air-fuel mixture flowing out of the Venturi tube in order to prevent solid impurities contained in the air-fuel mixture from reaching the apertures of the burner body. The above mentioned baffles avoid bending of the Venturi tube but the formation of the vortices in the flow of air-fuel mixture due to the presence of the baffles is detrimental to a uniform distribution of the air-fuel mixture to the apertures of the burner body.

U.S. Pat. No. 3,353,583 discloses a radiant burner fed with a flow of an air-fuel mixture, comprising a Venturi tube arranged at the inside of a burner body provided with an elongated aperture through which said flow passes, said aperture being covered by combustion sustaining screen assembly, said Venturi tube being supported to said body at one of its ends and being further supported by a curved baffle having an end which is aligned with a portion of the outlet of the Venturi tube and interferes with the flow of the air-fuel mixture in order to divide the flow into two streams directed to different portions of said elongated aperture. The baffle interferes with the flow of air-fuel mixture in the region of the outlet of the Venturi tube, when the speed of the mixture is relatively high, which implies a considerable turbulence in the flow of the mixture being generated, which increases the resistance of the burner and makes difficult to obtain a uniform distribution of the mixture through the elongated aperture.

EP-A-0 217 470 discloses a burner for gas boilers fed with a flow of an air-fuel mixture, comprising a Venturi tube arranged at the inside of a burner body provided with apertures through which said flow passes, said Venturi tube being supported to said body at one of its ends whilst the other end remains free. The burner is provided with a partition extending in an axial direction and provided in a region remote from said apertures with an opening, said partition being further provided with a deflector which diverts the air-fuel mixture flowing or the Venturi tube in the direction of the opening in the partition. The deflector and the partition reduces the turbulence of the air-flow mixture flowing out of the venturi tube and improve the uniformity of distribution of the mixture to the apertures of the burner body. However the Venturi tube, which is supported only at one end, is subjected to bending stresses which reduce the life of the burner.

This invention intends to eliminate the above mentioned drawbacks. According to the invention there is provided a burner comprising a tubular burner body, a Venturi tube arranged at the inside of said burner body and supplying a flow of air-fuel mixture to the inside of said bruner body provided with apertures through which said flow passes and generates a flame, one end of said Venturi tube being fixed to said burner body, additional support and centring means provided with control means for controlling the distribution of said flow of air-fuel mixture to said apertures, said support and centring means having a substantially flat shape, characterized in that said control means comprises openings defined in said support and centring means.

The invention will now be described with reference to the drawings, which illustrate, only by way of non-restrictive examples, some embodiments of the invention.

FIG. 1 is a longitudinal section of a burner according to the invention;

FIG. 2 in a section as in Figure, concerning a further embodiment of the invention;

With reference to the drawings, 1 denotes the body of a burner according to the invention, provided at the inside with a Venturi 2 tube fixed to the body 1 at a first end 3, for instance by welding.

The body 1 of the burner is provided with apertures (not shown), for instance shaped as slots, allowing an air-fuel mixture sucked through the Venturi tube 2 to pass from the inside to the outside of the body 1.

At the inside of the body 1, a first support and centring means of the Venturi tube 2 is arranged at an intermediate section of the Venturi tube 2 and a second support and centring means is arranged at a second end 6 of the Venturi tube 2.

Figure 3:
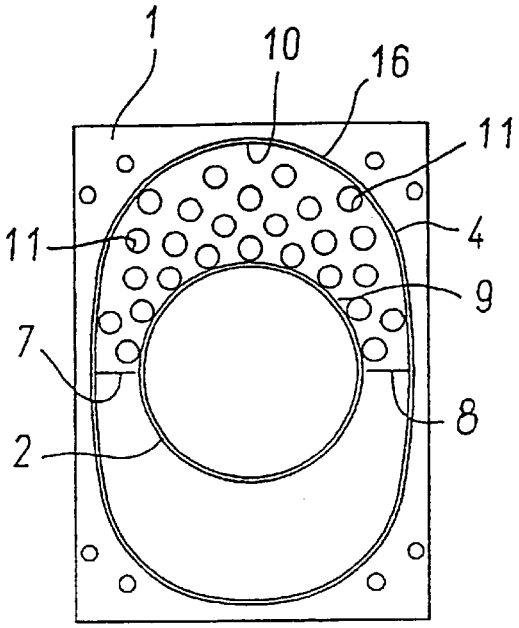
FIG. 3 is a cross section of FIG. 1, through a line III—III.
Figure 4:
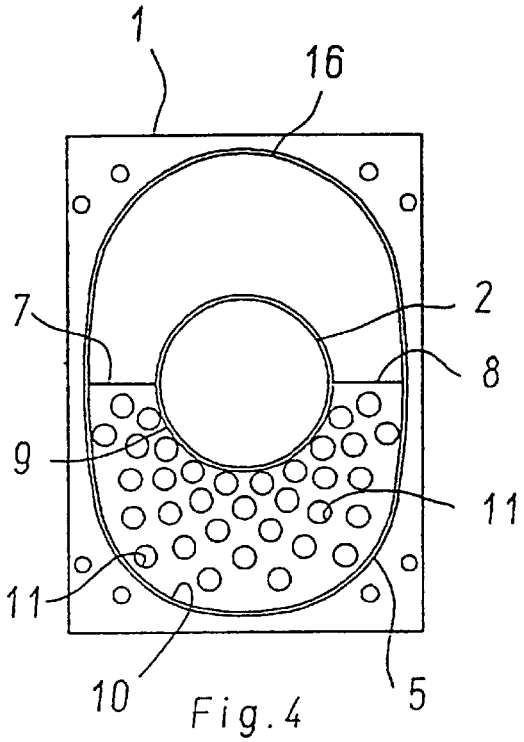
FIG. 4 is a cross section of FIG. 1, through a line IV—IV.

The second support and centring means may be even arranged at a second intermediate section of the Venturi tube 2. Said first 4 and second 5 support and centring means are substantially flat, and have substantially the same shape of the outer outline, comprising two substantially rectilinear stretches 7, 8 (FIG. 3) connected by a first interconnecting stretch 9, having an outline substantially matching the outer outline of the Venturi tube 2, and a second interconnecting stretch 10 having a shape substantially matching the shape of the inner surface 16 of the body 1.

On the surface of said first support and centring means 4 and second support and centring means 5 apertures 11 are made, allowing passage of the air-fuel mixture. The shape, dimensions and arrangement of said aperture 11 are such as to obtain a flow of mixture which can be controlled in any condition, after the mixture has passed through said apertures 11, thus obtaining, for instance, a uniform flow through the slots of the body 1. Said apertures 11 may have, for example, a circular shape, a triangular shape or any other shape. A substantially uniform flow through the slots of the body 1 means a flow of mixture having a speed vector with substantially constant, or in any event slightly different, magnitude and direction for each slot. This makes possible to obtain uniform flames, in normal operating conditions of the burner, that is flames having a substantially constant height, which do not detach from the surface of the burner and/or do not flatten on the body 1, thus causing overheating of the latter, when operating conditions, such as the rate of flow of the mixture or fuel, or the type of fuel used, are changed.

Figure 1:
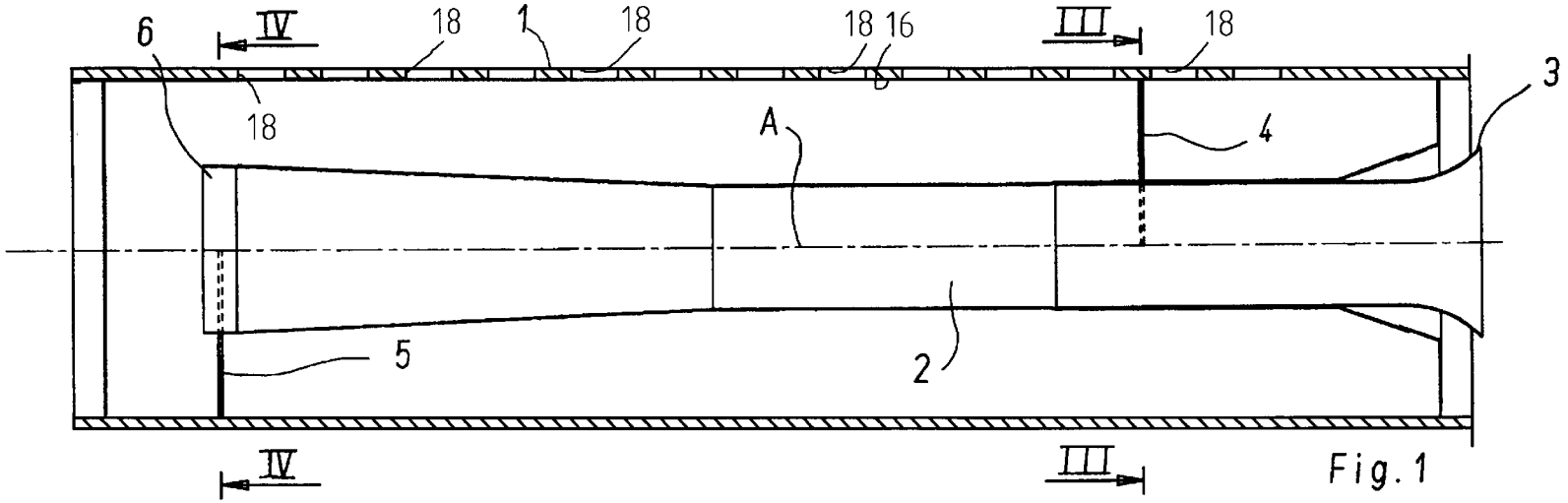
Figure 2:
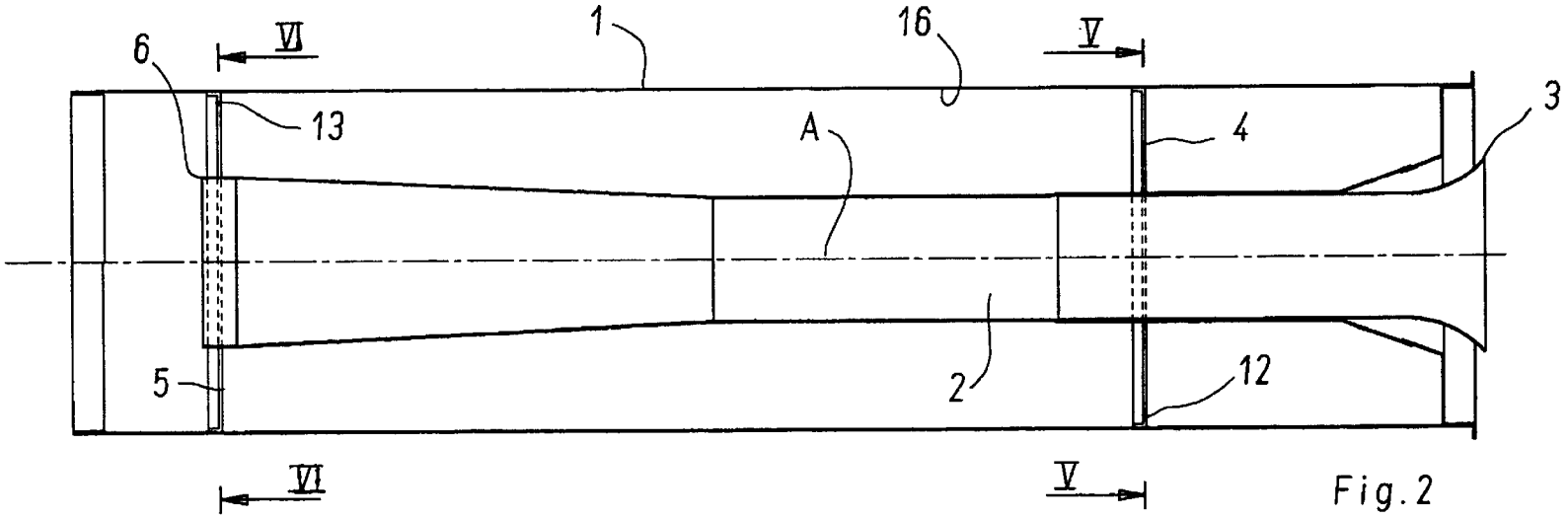
Figure 5:
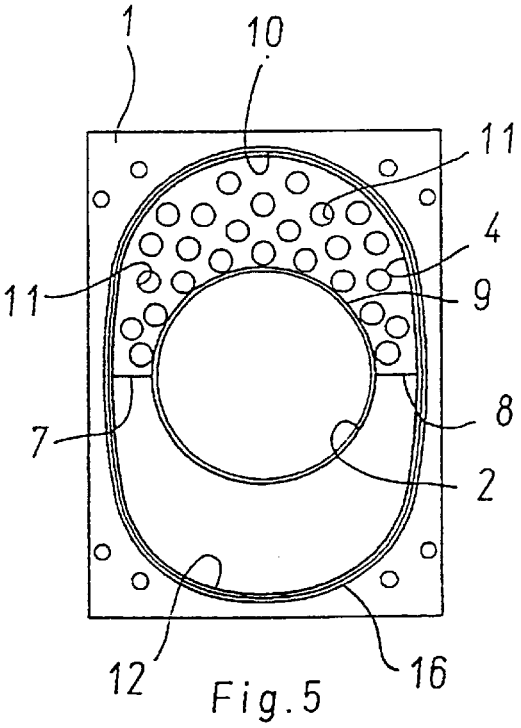
FIG. 5 is a cross section of FIG. 2, through a line V—V.
Figure 6:
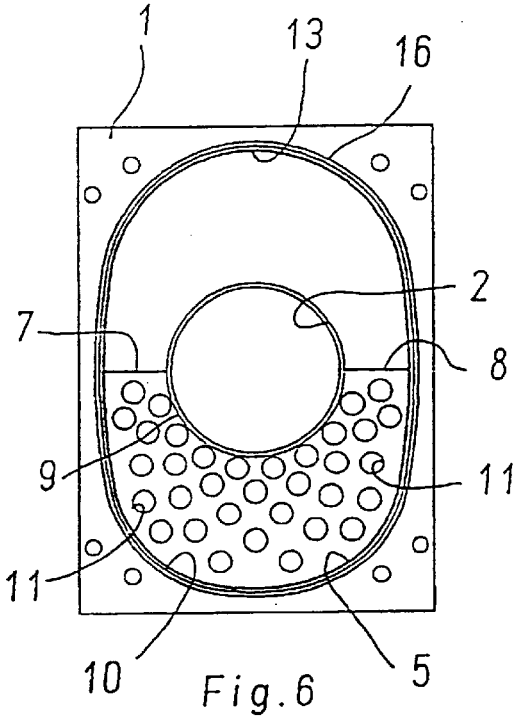
FIG. 6 is a cross section of FIG. 2, through a line VI—VI.

FIGS. 2, 5 and 6 illustrate a further embodiment of said first 4 and second 5 support and centring means of the Venturi tube 2. In said further embodiment, said first 4 and second 5 support and centring means are fixed to respective annular means 12, 13 having a shape substantially matching the shape of the outline of the inner surface 16 of the body 1, in order to make easier centring said means 4, 5 at the inside of the body 1.

Figure 8:
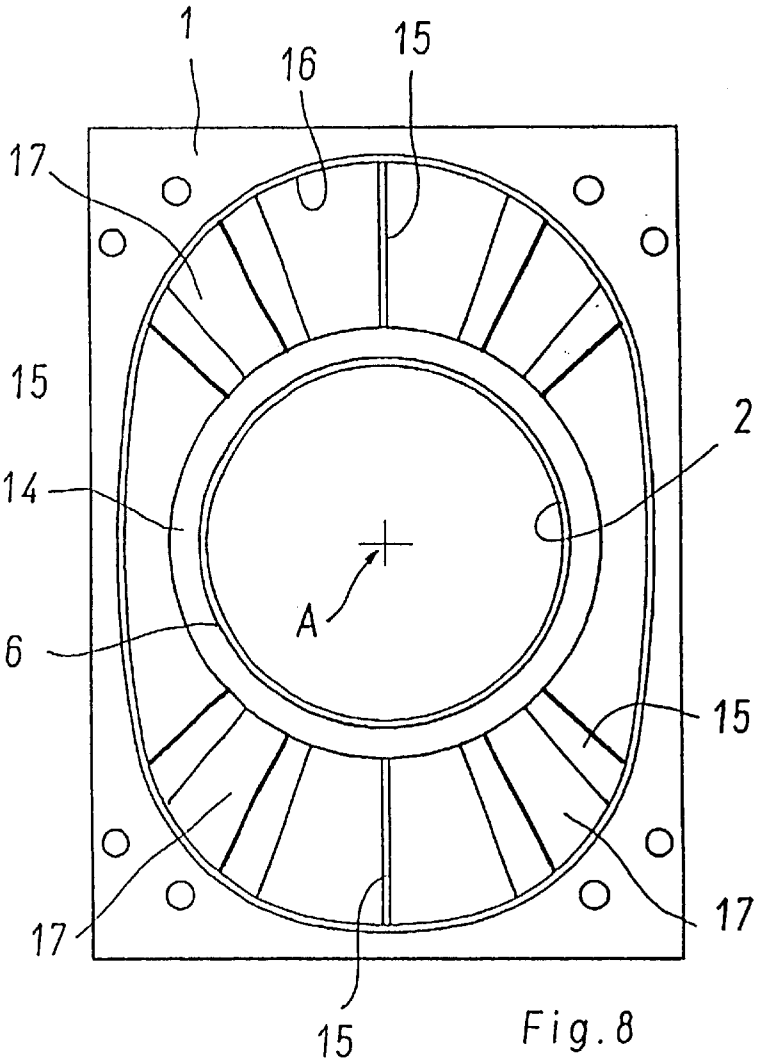
FIG. 8 is a cross section of FIG. 7, through a line VIII—VIII.
Figure 7:
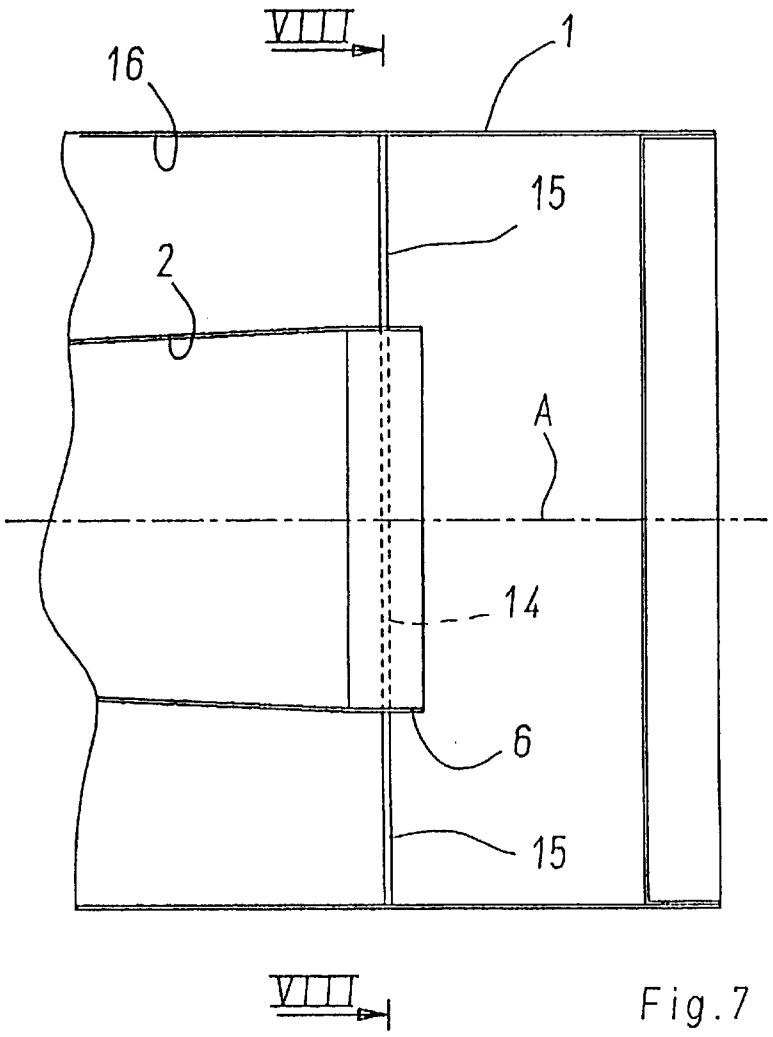
FIG. 7 is a longitudinal interrupted section as in FIG. 1, concerning a still further embodiment of a burner according to the invention.

FIGS. 7 and 8 illustrate a still further embodiment of the burner according to the invention, provided, for instance, at said second end 6 of the Venturi tube 2, with support and centring means 14, 15 comprising a ring 14 arranged on the Venturi tube 2 in contact with its outer surface, said ring being provided with a plurality of protrusions 15, for instance shaped as blades, facing toward the outside of the ring 14 and substantially radially directed with respect to the axis A of the burner. The ends of the protrusions 15 facing toward the inner surface of the body 1 lean against said inner surface and have an outline shape substantially matching the shape of said inner surface. Said blade-shaped protrusions 15 are dimensioned, arranged and oriented in such a way as to obtain a substantially uniform flow, or, in any event, a controlled distribution of flow. All that being obtained due to the inclination of the blades 15, which may be selected when planning the burner, so as to obtain a controlled flow through the slots, after the mixture has passed through the spaces 17 defined between pair of adjacent blades. For instance, each blade 15 may be arranged on a plane intersecting the axis of the burner at predetermined angle, which may be the same, or different, for each blade. In addition, each blade may have a uniform width, or a width increasing toward the end which is in contact with the inner surface 16 of the burner 1. The protrusions 15 shaped as blades may be part of the body of the Venturi tube 2, thus making possible not to use the ring 14. The surface of the blades may be flat or may be curved in a radial or and/or in an axial direction. In the latter case, the surface of each blade may have the same radii of curvature, or different radii.

The support and centring means 4, 5 and 14, 15 make possible to keep the Venturi tube centred with respect to the axis A of the burner, which is advantageous for the purpose of controlling the flow of the air-fuel mixture through the slots and makes possible to limit the bending of the Venturi tube caused by its own weight or other stresses.

What is claimed is:

1. A burner comprising;

a tubular burner body, a venturi rube arranged at the inside of said burner body and supplying a flow of air-fuel mixture to the inside of said burner body, said burner body being provided with apertures through which said flow passes and generates a flame, one end of said venturi tube being fixed to said burner body to support and center said venture tube at said one end, additional support and centering means of said venturi tube provided with control means for controlling the distribution of said flow of air-fuel mixture to said apertures, said support and centering means having a substantially flat shape, said control means comprising openings defined in said support and centering means, and said additional support and centering means having first support and centering means arranged at a first intermediate section of said venturi tube and second support and centering means.

2. A burner according to claim 1, wherein said second support and centering means are arranged near a second end of said venturi tube.

3. A burner according to claim 1, wherein said second support and centering means are arranged at a second intermediate section of said venturi rube.

4. A burner according to claim 3, wherein said second support and centering means has a substantially flat shape.

5. A burner according to claim 4, wherein said control means comprises openings defined in said second support and centering means.

6. A burner according to claim 5, wherein said openings have a substantially circular shape.

7. A burner according to claim 4, wherein said second support and centering means has an outer profile comprising two substantially rectilinear stretches connected by a first connecting stretch, having a shape substantially matching the shape of an outer outline of the venturi tube, and by a second connecting stretch, having a shape substantially matching the shape of an outline of the inner surface of the body.

8. A burner according to claim 5, wherein said second support and centering means is associated to ring means having a shape substantially matching the shape of the outline of the inner surface of the body.

9. A burner according to claim 1, wherein said first support and centering means has an outer profile comprising two substantially rectilinear stretches connected by a first connecting stretch, having a shape substantially matching the shape of an outer outline of the venturi tube, and by a second connecting stretch, having a shape substantially matching the shape of an outline of an inner surface of the body.

10. A burner according to claim 1, wherein said first support and centering means is associated to ring means having a shape substantially matching the shape of an outline of an inner surface of the body.

11. A burner according to claim 1, wherein said control means comprises protrusions of said first support and centering means, said protrusions being aligned in a substantially radial direction with respect to a longitudinal axis of the burner, said openings being defined between adjacent pairs of said protrusions.

12. A burner according to claim 11, wherein said first support and centering means comprises ring means arranged on the venturi tube in contact with its outer surface, said ring means being provided with said protrusions.

13. A burner according to claim 11, wherein said protrusions are part of the body of the venturi tube.

14. A burner according to claim 13, wherein each of said protrusions has an end facing toward an inner surface of the body and leaning against said inner surface.

15. A burner according to claim 14, wherein said end has an outline having a shape substantially matching the shape of said inner surface.

16. A burner according to claim 13, wherein said protrusions are substantially blade shaped.

17. A burner according to claim 16, wherein each of said substantially blade shaped protrusions lies on a respective plane intersecting said longitudinal axis at a predetermined angle.

18. A burner according to claim 17, wherein said predetermined angle is the same for each of said substantially blade shaped protrusions.

19. A burner according to claim 17, wherein said predetermined angle is not the same for each of said blade shaped protrusions.

20. A burner according to claim 16, wherein said blade shaped protrusion have a constant width.

21. A burner according to claim 16, wherein said blade shaped protrusions have a width increasing toward said end facing toward said inner surface.

22. A burner according to claim 16, wherein said blade shaped protrusions has a surface curved in a axial direction.

23. A burner according to claim 16, wherein said blade shaped protrusions has a surface curved in an radial direction.

24. A burner according to claim 23, wherein said blade shaped protrusions has a surface curved in an axial direction.

25. A burner according to claim 24, wherein the radius of curvature of said surface is the same for each of said blade shaped protrusions.

26. A burner according to claim 24, wherein the radius of curvature of said surface is not the same for each of said blade shaped protrusion.

* * * * *